US007422429B2

(12) United States Patent
Lin

(10) Patent No.: US 7,422,429 B2
(45) Date of Patent: Sep. 9, 2008

(54) HEAT EXCHANGE FURNACE AND ITS MANUFACTURING PROCESS

(75) Inventor: Jung-Lang Lin, Wu Feng Hsiang (TW)

(73) Assignee: Suncue Company Ltd. (TW)

( * ) Notice: Subject to any disclaimer, the term of this patent is extended or adjusted under 35 U.S.C. 154(b) by 170 days.

(21) Appl. No.: 11/503,251

(22) Filed: Aug. 14, 2006

(65) Prior Publication Data

US 2008/0070180 A1 Mar. 20, 2008

(51) Int. Cl.
*F28D 7/10* (2006.01)

(52) U.S. Cl. ..... 432/219; 432/223; 165/157; 126/99 A

(58) Field of Classification Search ..... 432/219, 432/223, 164, 165, 178, 185, 194, 209, 212, 432/217; 126/99 A, 99 C, 99 D, 68, 69, 77, 126/83, 110 R, 70–72; 165/157, 159
See application file for complete search history.

(56) References Cited

U.S. PATENT DOCUMENTS

| | | | | |
|---|---|---|---|---|
| 3,796,547 | A * | 3/1974 | Muenger | 422/200 |
| 4,319,557 | A * | 3/1982 | Sietmann et al. | 126/110 R |
| 4,449,510 | A | 5/1984 | Sukup | |
| 4,579,102 | A * | 4/1986 | Sukup | 126/99 A |
| 6,918,433 | B2 * | 7/2005 | Kontu | 165/160 |
| 2007/0169924 | A1 * | 7/2007 | Bussonnet | 165/157 |

* cited by examiner

*Primary Examiner*—Gregory A Wilson
(74) *Attorney, Agent, or Firm*—Davidson Berquist Jackson & Gowdey LLP

(57) ABSTRACT

A heat exchange furnace includes a combustion furnace module, a passageway module disposed around and connected removably to the combustion furnace module, and a gas-guiding unit including upper and lower guiding modules connected respectively to upper and lower ends of the passageway module. During assembly, the lower guiding module is first connected removably to the passageway module. Subsequently, the passageway module is sleeved removably on the combustion furnace module. Finally, the upper guiding module is connected removably to the passageway module.

8 Claims, 9 Drawing Sheets

HEAT EXCHANGE FURNACE AND ITS MANUFACTURING PROCESS

BACKGROUND OF THE INVENTION

1. Field of the Invention

This invention relates to a furnace, more particularly to a heat exchange furnace and its manufacturing process.

2. Description of the Related Art

U.S. Pat. No. 4,449,510 discloses a biomass heat exchange furnace for burning biomass to thereby generate high-temperature combustion gases. Ambient or fresh air is forced into the heat exchange furnace for heat exchange contact with the combustion gases. As such, the temperature of the combustion gases is reduced prior to exhaust from the heat exchange furnace.

On the other hand, the ambient air is heated to form hot air that may serve as a heat source for various utilizations.

A drawback of the aforesaid heat exchange furnace is that, during assembly, the components thereof are assembled individually one at a time, thereby resulting in a troublesome manufacturing process.

SUMMARY OF THE INVENTION

The object of this invention is to provide a heat exchange furnace that has a module unit including a combustion furnace module, a passageway module, and two gas guiding modules which are interconnected such that the heat exchange furnace can be manufactured with ease.

According to an aspect of this invention, there is provided a heat exchange furnace comprising:

- a combustion furnace module adapted to burn fuel such that combustion gases are generated therein;
- a passageway module including
  - an annular surrounding plate disposed around the combustion furnace module so as to define an annular heat exchange space therebetween,
  - a top annular plate connected removably to the combustion furnace module and having an outer peripheral portion connected fixedly to an upper end of the surrounding plate for sealing an upper end of the heat exchange space,
  - a bottom annular plate connected removably to the combustion furnace module and having an outer peripheral portion connected fixedly to a lower end of the surrounding plate for sealing a lower end of the heat exchange space, and
  - at least one conduit unit including a plurality of conduit sets that are disposed within the heat exchange space and around the combustion furnace module and that have upper ends extending sealingly through the top annular plate, and lower ends extending sealingly through the bottom annular plate; and
- a gas-guiding unit including an upper guiding module disposed removably on and above the top annular plate and formed with a gas outlet unit for permitting the exhaust of the combustion gases from the heat exchange furnace therethrough, and a lower guiding module disposed removably on and under the bottom annular plate and cooperating with the upper guiding module so as to limit a direction of flow of the combustion gases through each of the conduit sets such that the conduit sets as well as the upper and lower guiding modules constitute cooperatively a serpentine gas flow path for the combustion gases, the gas-guiding unit guiding the combustion gases to flow from the combustion chamber to the gas outlet unit via the serpentine gas flow path.

According to another aspect of this invention, there is provided a process for manufacturing a heat exchange furnace, comprising the steps of:

(1) connecting a lower guiding module removably to a lower end of a passageway module;

(2) connecting an assembly of the passageway module and the lower guiding module removably to a combustion furnace module in such a manner that the assembly of the passageway module and the lower guiding module is disposed around the combustion furnace module; and (3) connecting an upper guiding module removably to an upper end of the passageway module.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
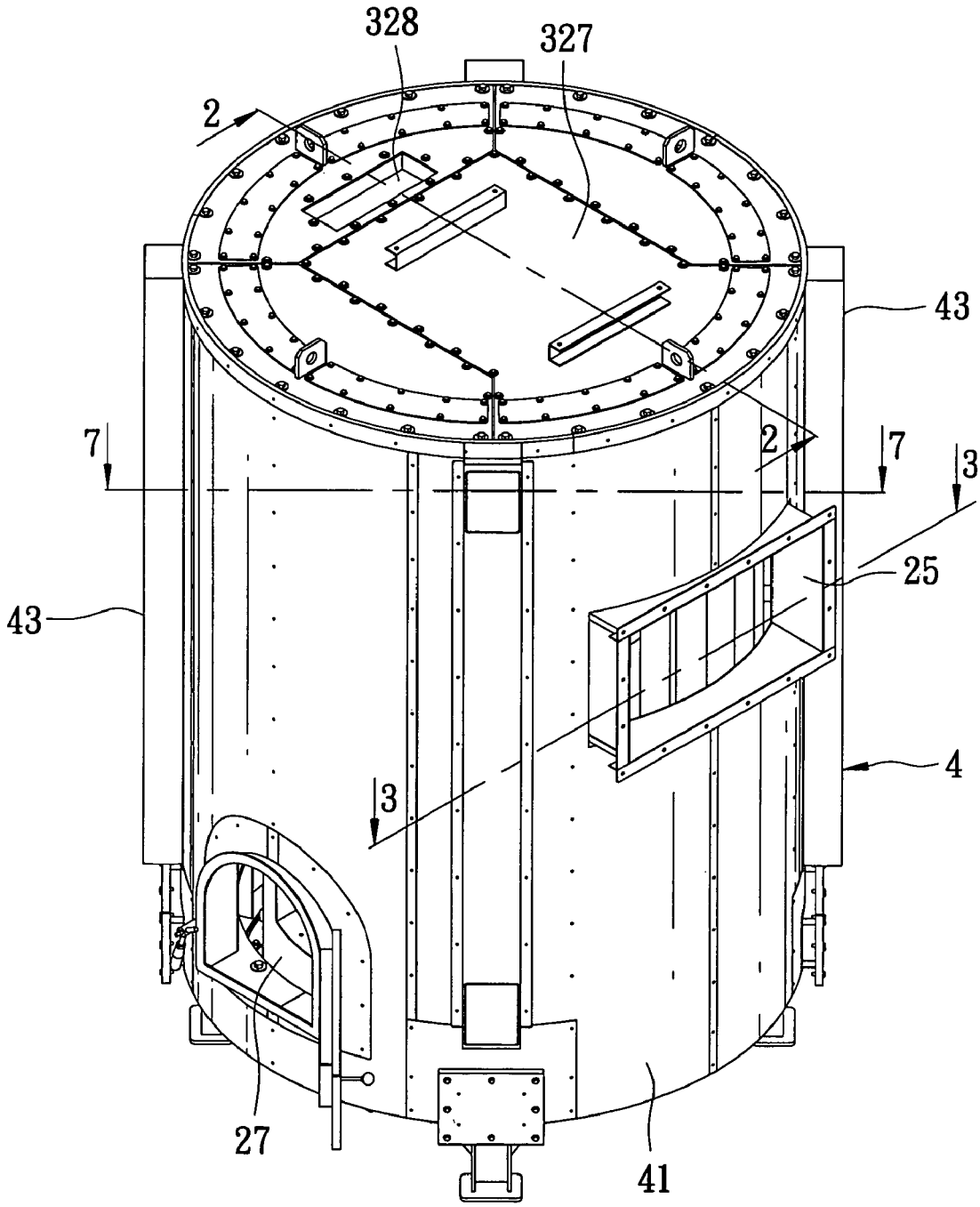
FIG. 1 is a perspective view of the first preferred embodiment of a heat exchange furnace according to this invention.

Before the present invention is described in greater detail in connection with the preferred embodiments, it should be noted that similar elements and structures are designated by like reference numerals throughout the entire disclosure.

Referring to FIGS. 1, 2, 3, and 4, the first preferred embodiment of a heat exchange furnace according to this invention includes a combustion furnace module 1, a passageway module 2, a gas-guiding unit 3, and a thermal insulating device 4.

The combustion furnace module 1 has a combustion chamber 11 adapted to burn fuel (such as corn stalks, cobs, etc.) so that combustion gases and heat are generated therein. The combustion furnace module 1 includes a furnace wall 12 defining the combustion chamber 11, a bottom wall 13, a fireproofing layer 14, a plurality of vent holes 15, a plurality of air tubes 16, and an opening 17 (see FIG. 4). The vent holes 15 are formed through the furnace wall 12, and are inclined relative to a radial direction of the furnace wall 12 so as to allow air to flow into the combustion chamber 11 therethrough. The inclined formation of the vent holes 15 aids in creating a swirling motion of the air within the combustion chamber 11. The bottom wall 13 is connected fixedly to an open lower end of the furnace wall 12 for sealing the same.

The fireproofing layer 14 is disposed on inner surfaces of the furnace wall 12 and the bottom wall 13. The air tubes 16 extend through the passageway module 2 to thereby communicate the ambient surroundings with the vent holes 15, respectively. The opening 17 is formed through the furnace wall 12.

The passageway module 2 includes a top annular plate 21, a bottom annular plate 22, a conduit assembly 23, an annular surrounding plate 24, an air inlet unit 25, an air outlet unit 26, and a fuel inlet 27. The top and bottom annular plates 21, 22 have outer peripheral portions connected respectively and fixedly to upper and lower ends of the surrounding plate 24, and are connected removably to the combustion furnace module 1 by bolts. The surrounding plate 24 is disposed around the combustion furnace module 1 so as to define an annular exchange space 20 therebetween. The air tubes 16 extend through the exchange space 20. The top and bottom annular plates 21, 22 seal respectively upper and lower ends of the heat exchange space 20. The conduit assembly 23 includes a first conduit set consisting of eight first conduits 231, a second conduit set including four second conduits 232, a third conduit set consisting of four third conduits 233, a fourth conduit set consisting of four fourth conduits 234, a fifth conduit set consisting of four fifth conduits 235, and a sixth conduit set consisting of eight sixth conduits 236. The first, second, third, fourth, fifth, and sixth conduits 231, 232, 233, 234, 235, 236 are disposed within the heat exchange space 20 and around the combustion furnace module 1, and have upper ends extending sealingly through the top annular plate 21, and lower ends extending sealingly through the bottom annular plate 22. Four of the first conduits 231 nearer to the second conduits 232, the second conduits 232, the fourth conduits 234, and four of the sixth conduits 236 nearer to the fourth conduits 234 constitute a first conduit unit. The other four of the first conduits 231, the third conduits 233, the fifth conduits 235, and the other four of the sixth conduits 236 constitute a second conduit unit. The air inlet and outlet units 25, 26 are formed through the surrounding plate 24, and are communicated with the heat exchange space 20. The fuel inlet 27 is also formed through the surrounding plate 24, and is aligned with the opening 17 in the combustion furnace module 1. As such, fuel can be fed into the combustion chamber 11 through the fuel inlet 27 and the opening 17.

Figure 2:
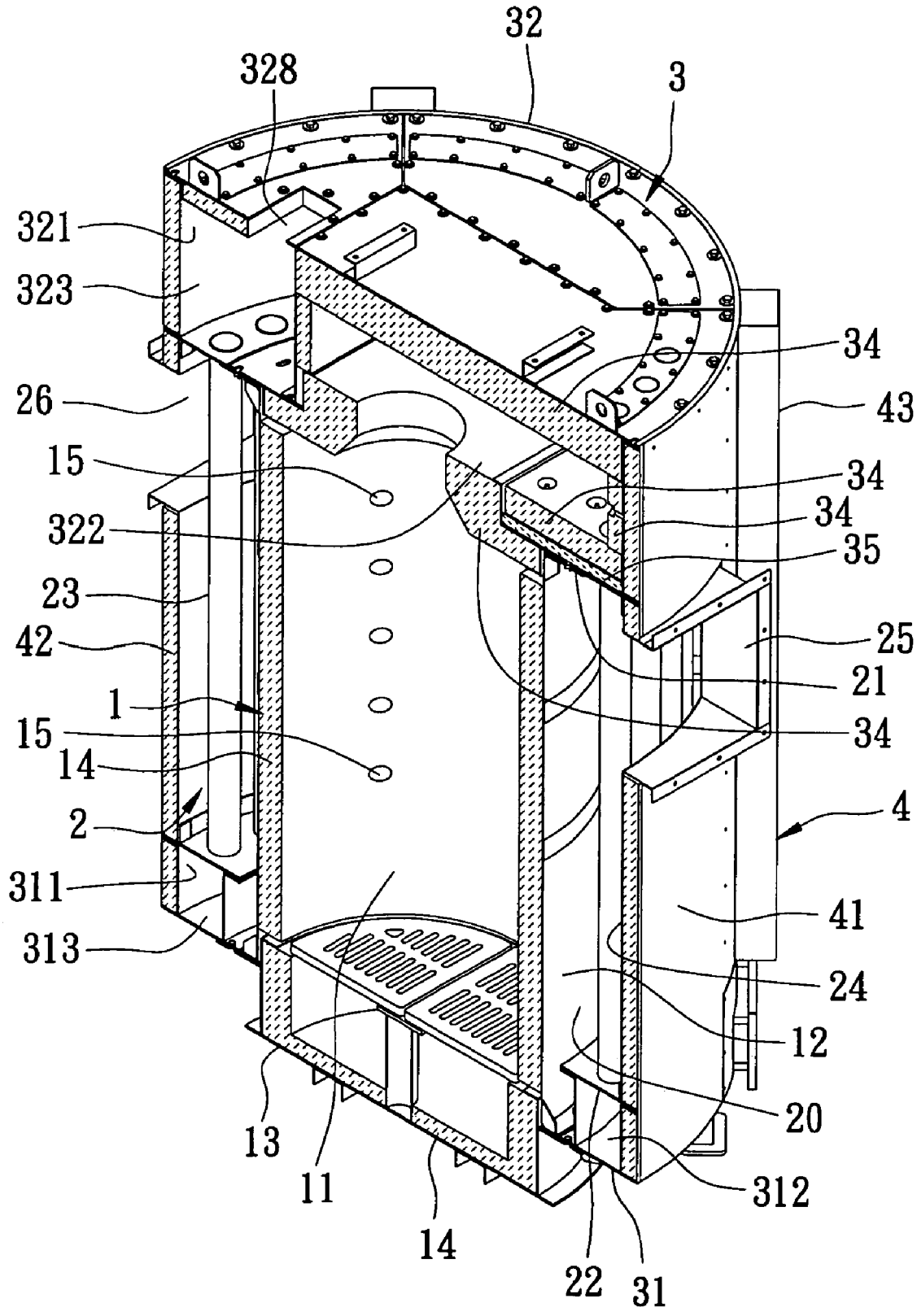
FIG. 2 is a fragmentary, partly sectional perspective view taken along Line 2-2 in FIG. 1.
Figure 3:
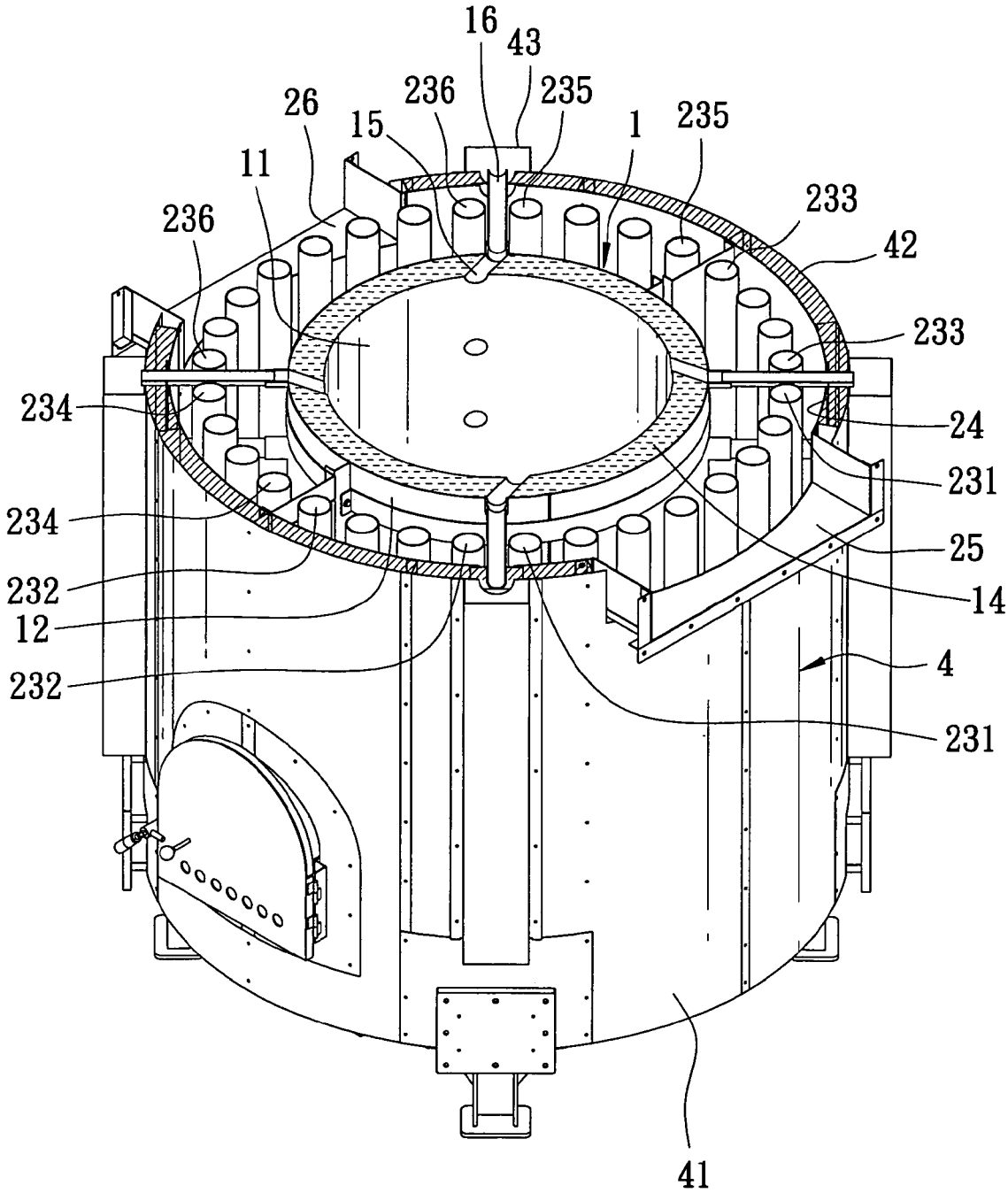
FIG. 3 is a fragmentary, partly sectional perspective view taken along Line 3-3 in FIG. 1.
Figure 4:
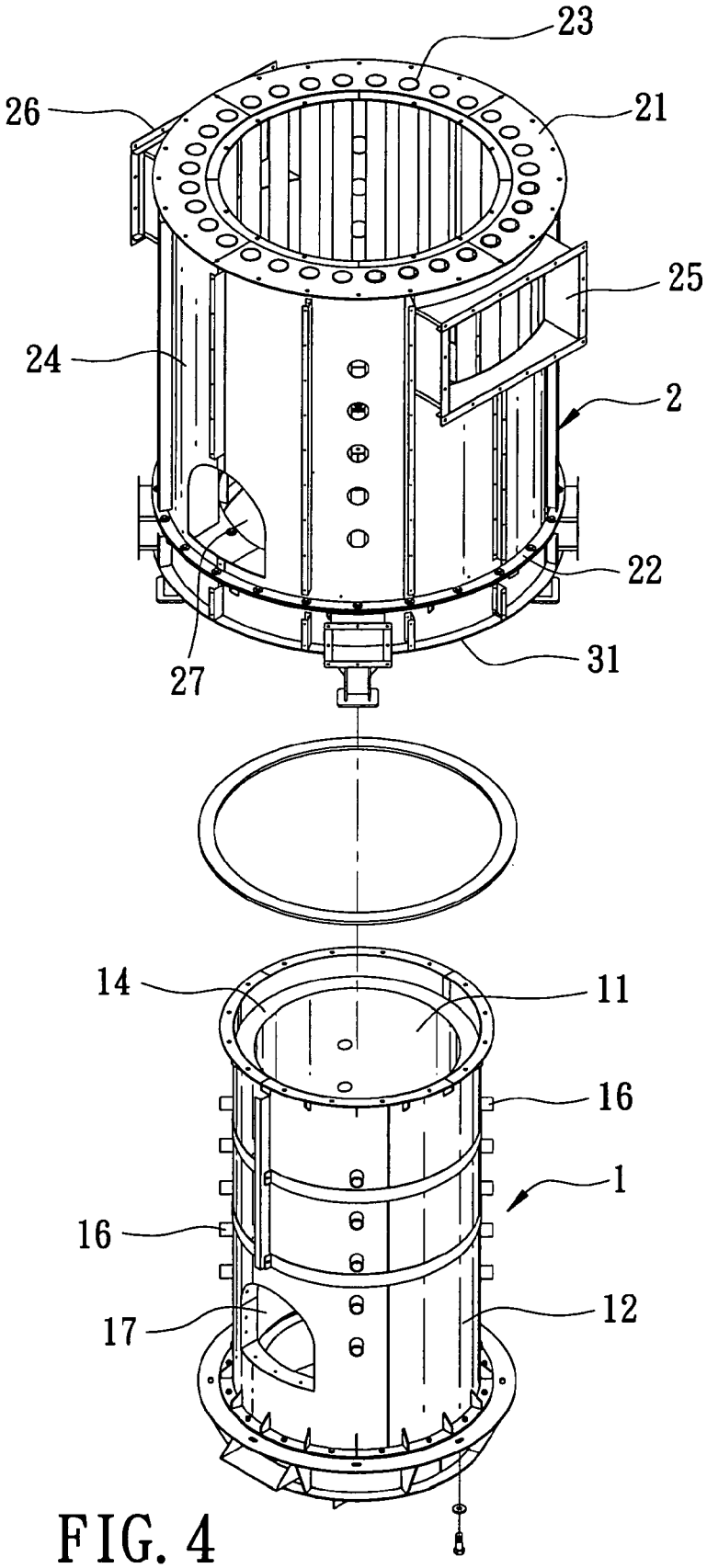
FIG. 4 is a partly exploded perspective view of a combustion furnace module, a passageway module, and a lower guiding module of the preferred embodiment.
Figure 5:
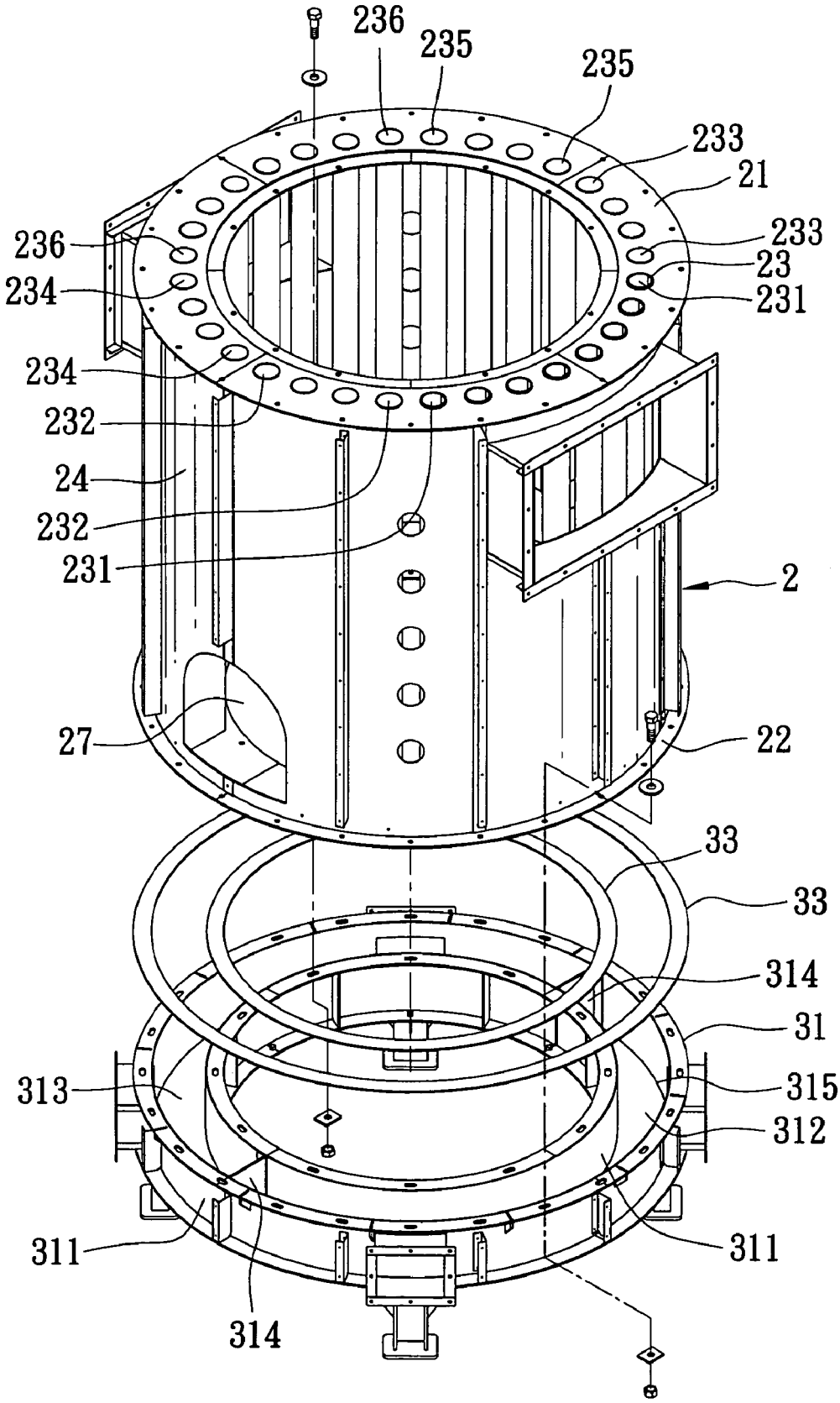
FIG. 5 is an exploded perspective view of the passageway module and the lower guiding module of the first preferred embodiment.
Figure 6:
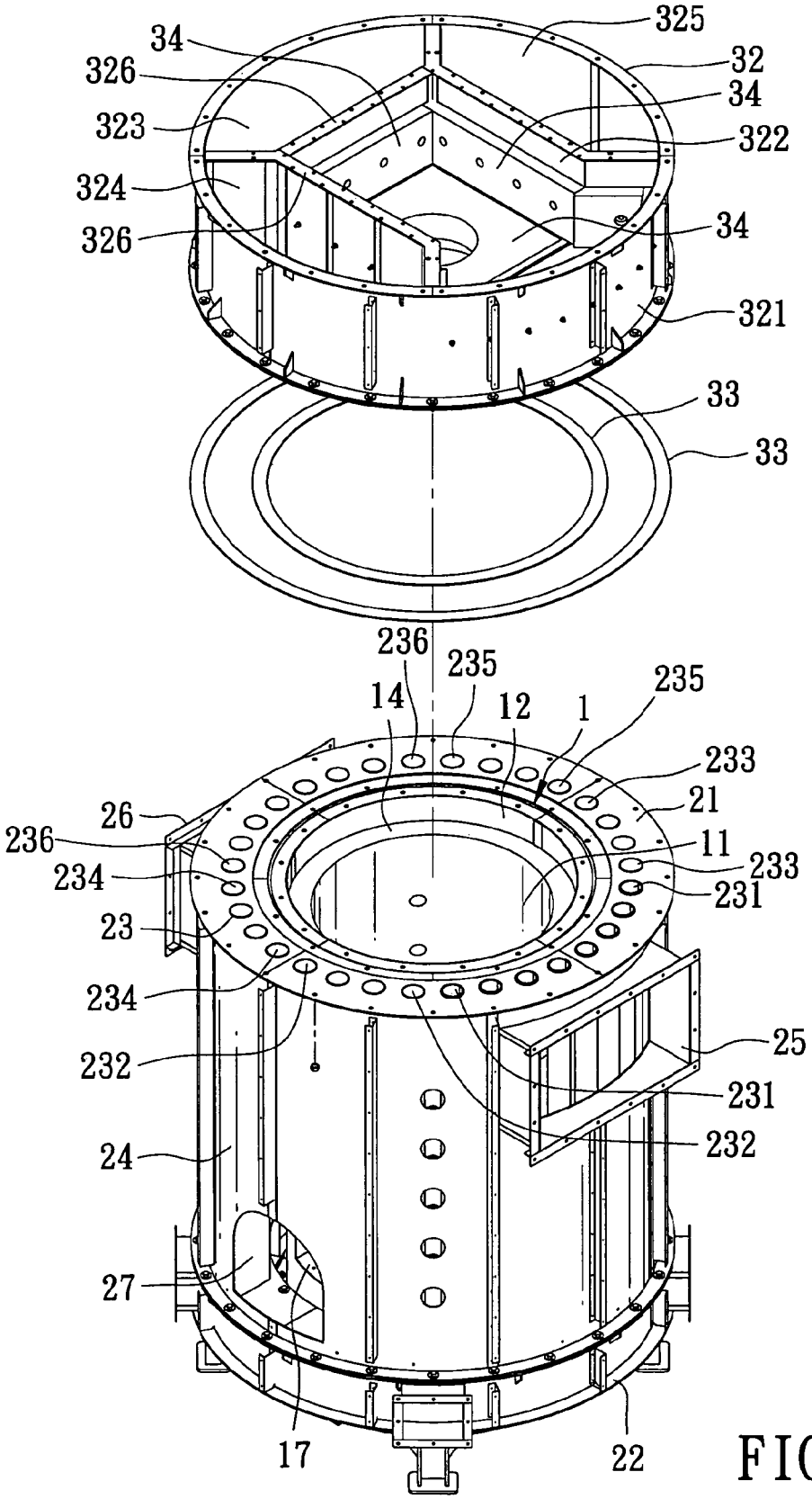
FIG. 6 is an exploded perspective view of the passageway module and an upper guiding module of the first preferred embodiment.

With additional reference to FIGS. 5 and 6, the gas-guiding unit 3 includes a lower guiding module 31, an upper guiding module 32, a plurality of heat-resisting upper and lower seal rings 33, a fireproofing layer 34, and a thermal insulating layer 35 (see FIG. 2). The upper guiding module 32 is disposed removably on and above the top annular plate 21 by bolts, and is formed with a gas outlet unit 328. The lower guiding module 31 is disposed removably on and under the bottom annular plate 21 by bolts, and cooperates with the upper guiding module 32 so as to limit a direction of flow of the combustion gases through each of the first, second, third, fourth, fifth, and sixth conduits 231, 232, 233, 234, 235, 236. Each of the first and second conduit units cooperates with the upper and lower guiding modules 32, 31 so as to constitute a serpentine gas flow path. The gas-guiding unit 3 guides the combustion gases to flow from the combustion chamber 11 to the gas outlet unit 328 via the serpentine gas flow paths.

The heat-resisting upper seal rings 33 are disposed between the upper guiding module 32 and the top annular plate 21 so as to establish a gas-tight seal therebetween. The heat-resisting lower seal rings 33 are disposed between the lower guiding module 31 and the bottom annular plate 22 so as to establish a gas-tight seal therebetween.

The lower guiding module 31 includes two surrounding walls 311, two aligned partitions 314, and an annular bottom wall 315. One of the surrounding walls 311 is disposed around the other of the surrounding walls 311. The bottom wall 315 is interconnected fixedly between lower ends of the surrounding walls 311, and cooperates with the surrounding walls 311 so as to define a lower guiding space thereamong. The partitions 314 are interconnected fixedly between the surrounding walls 311 for dividing the lower guiding space into a pair of first and second lower gas transfer chambers 312, 313. The first lower gas transfer chamber 312 is communicated with lower ends of the first, second, and third conduits 231, 232, 233. The second lower gas transfer chamber 313 is communicated with lower ends of the fourth, fifth, and sixth conduits 234, 235, 236.

Figure 7:
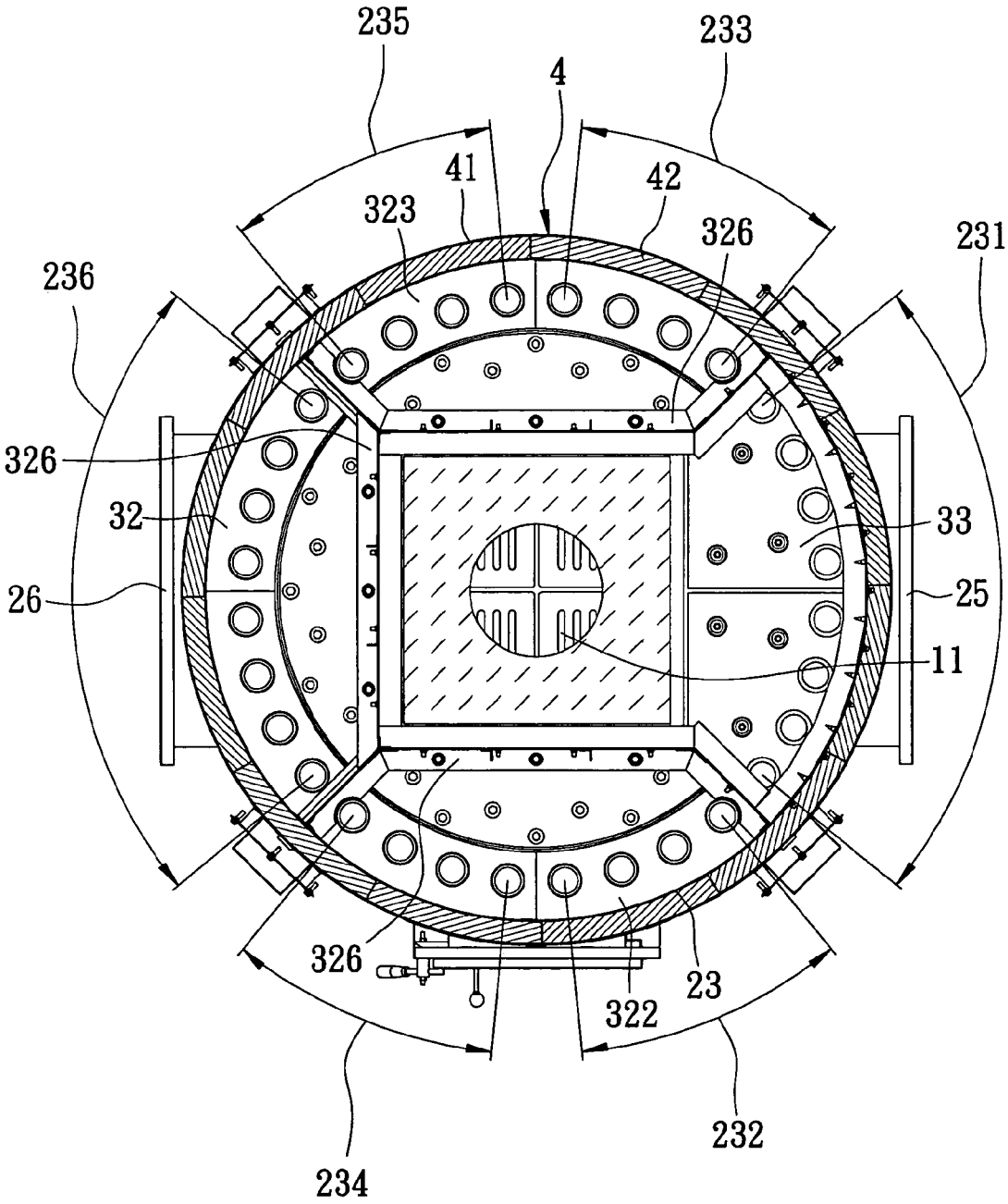
FIG. 7 is a sectional view taken along Line 7-7 in FIG. 1.

With particular reference to FIGS. 6 and 7, the upper guiding module 32 includes a surrounding wall 321, a plurality of partitions 326, and a top wall 327 (see FIG. 1). The top wall 327 is connected fixedly to an upper end of the surrounding wall 321, and cooperates with the surrounding wall 321 so as to define an upper guiding space therebetween. The gas outlet unit 328 is formed through the top wall 327 so as to allow the exhaust of the combustion gases from the heat exchange furnace therethrough.

The partitions 326 are connected fixedly to the surrounding wall 321 and the top wall 327 for dividing the upper guiding space into a gas entrance chamber 322, a gas exit chamber 323, and a pair of first and second upper gas transfer chambers 324, 325. The gas entrance chamber 322 is communicated with the combustion chamber 11 in the combustion furnace module 1 and upper ends of the first conduits 231. The first upper gas transfer chamber 324 is communicated with upper ends of the second and fourth conduits 232, 234. The second upper gas transfer chamber 325 is communicated with upper ends of the third and fifth conduits 233, 235. The gas exit chamber 323 is communicated with upper ends of the sixth conduits 236 and the gas outlet unit 328.

Figure 8:
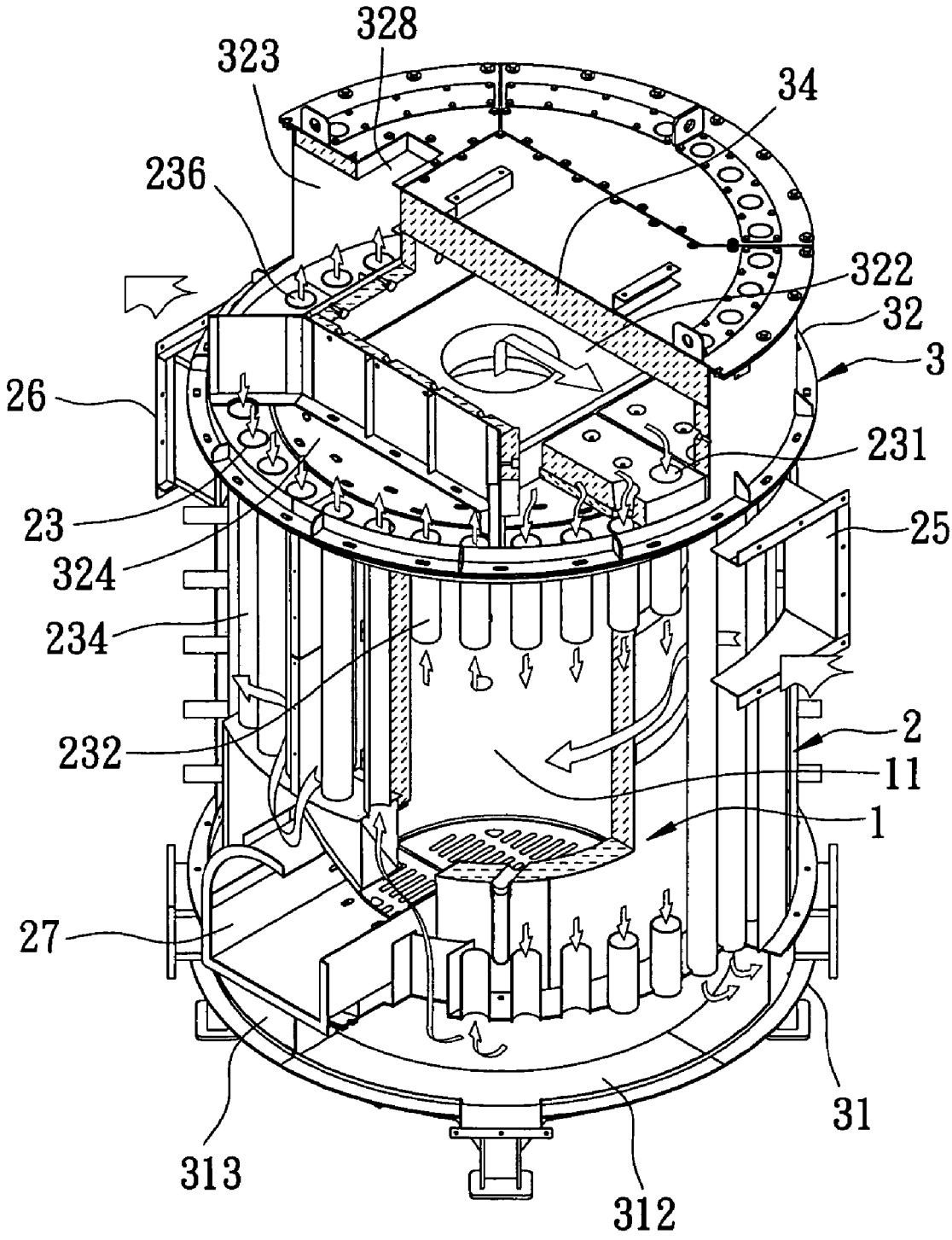
FIG. 8 is a fragmentary, partly sectional perspective view of the first preferred embodiment.

As such, in each of the first, second, third, fourth, fifth, and sixth conduits 231, 232, 233, 234, 235, 236, the combustion gases are limited to flow in a single direction. That is, the combustion gases flow downwardly within the first, fourth, and fifth conduits 231, 234, 235, and upwardly within the second, third, and sixth conduits 232, 233, 236, as shown in FIG. 8. As a result, the upper and lower guiding modules 32, 31 cooperate with the first conduit unit so as to constitute a first serpentine gas flow path, and with the second conduit unit so as to constitute a second serpentine gas flow path. Such a structure improves the heat exchange efficiency.

The fireproofing layer 34 is disposed on surfaces of the top wall 327, the top annular plate 21, and the partitions 326, which define cooperatively the gas entrance chamber 322.

The thermal insulating layer 35 is sandwiched between the top annular plate 21 and the fireproofing layer 34.

With reference to FIGS. 1, 2, 3, and 7, the thermal insulating device 4 includes an annular outer layer 41 disposed around and connected fixedly to an assembly of the passageway module 2 and the gas-guiding unit 3, an annular thermal insulating layer 42 (see FIG. 2) sandwiched between the outer layer 41 and an assembly of the passageway module 2 and the gas-guiding unit 3, and a plurality of elongated covers 43 having a U-shaped cross section and attached fixedly to the outer layer 41 for covering the air tubes 16, respectively.

In this embodiment, a process for manufacturing the heat exchange furnace includes the following steps of:

(1) connecting the lower guiding module 31 removably to a lower end of the passageway module 2;

(2) connecting an assembly of the passageway module 2 and the lower guiding module 31 removably to the combustion furnace module 1;

(3) connecting the upper guiding module 32 removably to an upper end of the passageway module 2; and (4) connecting the thermal insulating device 4 fixedly to the assembly of the passageway module 2 and the gas-guiding unit 3.

When fuel is burnt within the combustion chamber 11 in the combustion furnace module 1, ambient or fresh air flows into the combustion chamber 11 via the air tubes 16 and the vent holes 15. A portion of the combustion gases flows along the first serpentine gas flow path defined by the gas entrance chamber 322, four of the first conduits 231, the first lower gas transfer chamber 312, the second conduits 232, the first upper gas transfer chamber 324, the fourth conduits 234, the second lower gas transfer chamber 313, four of the sixth conduits 236, and the gas exit chamber 323. The remaining portion of the combustion gases flows along the second serpentine gas flow path defined by the gas entrance chamber 322, the other four of the first conduits 231, the first lower gas transfer chamber 312, the third conduits 233, the second upper gas transfer chamber 324, the fifth conduits 235, the second lower gas transfer chamber 313, the other four of the sixth conduits 236, and the gas exit chamber 323.

When the combustion gases flow within the first, second, third, fourth, fifth, and sixth conduits 231, 232, 233, 234, 235, 236, cold air flows into the heat exchange space 20 through the air inlet unit 25 for heat exchange contact therewith. Hence, the temperature of the combustion gases is reduced prior to exhaust from the heat exchange furnace. On the other hand, the air in the heat exchange space 20 is heated to thereby form hot air. The hot air is removed from the heat exchange furnace through the air outlet unit 26 into piping (not shown), and may serve as a heat source for various utilizations.

Figure 9:
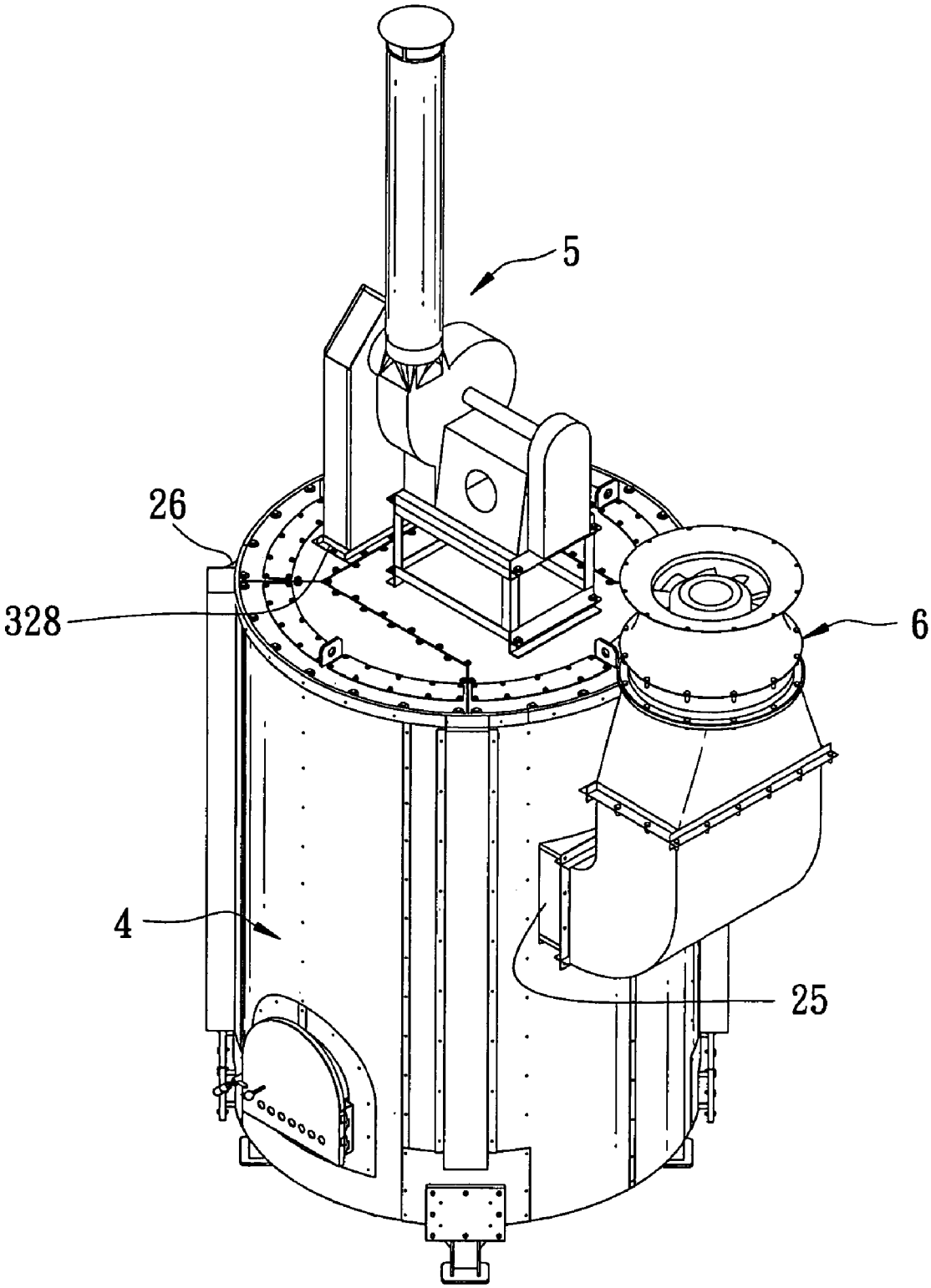
FIG. 9 is a perspective view of the second preferred embodiment of a heat exchange furnace according to this invention, illustrating how two fan units are added to the first preferred embodiment.

Referring to FIG. 9, the heat exchange furnace may further include two fan units 5, 6 that are mounted respectively to the gas outlet unit 328 and the air inlet 25. As such, cold air can be forced into the air inlet 25, and the combustion gas can be forced to exit from the gas outlet unit 328.

Since the combustion furnace module 1, the passageway module 2, and the upper and lower guiding modules 32, 31 can be conveniently assembled together to form a module unit, the heat exchange furnace of this invention can be manufactured with ease. Thus, the object of this invention is achieved.

With this invention thus explained, it is apparent that numerous modifications and variations can be made without departing the scope and spirit of this invention. It is therefore intended that this invention be limited only as indicated by the appended claims.

I claim:

1. A heat exchange furnace comprising:

a combustion furnace module adapted to burn fuel such that combustion gases are generated therein;

a passageway module including an annular surrounding plate disposed around said combustion furnace module so as to define an annular heat exchange space therebetween, a top annular plate connected removably to said combustion furnace module and having an outer peripheral portion connected fixedly to an upper end of said surrounding plate for sealing an upper end of said heat exchange space, a bottom annular plate connected removably to said combustion furnace module and having an outer peripheral portion connected fixedly to a lower end of said surrounding plate for sealing a lower end of said heat exchange space, and at least one conduit unit including a plurality of conduit sets that are disposed within said heat exchange space and around said combustion furnace module and that have upper ends extending sealingly through said top annular plate, and lower ends extending sealingly through said bottom annular plate; and a gas-guiding unit including an upper guiding module disposed removably on and above said top annular plate and formed with a gas outlet unit for permitting the exhaust of the combustion gases from said heat exchange furnace therethrough, and a lower guiding module disposed removably on and under said bottom annular plate and cooperating with said upper guiding module so as to limit a direction of flow of the combustion gases through each of said conduit sets such that said conduit sets as well as said upper and lower guiding modules constitute cooperatively a serpentine gas flow path for the combustion gases, said gas-guiding unit guiding the combustion gases to flow from said combustion furnace module to said gas outlet unit via said serpentine gas flow path.

2. The heat exchange furnace as claimed in claim 1, wherein said combustion furnace module includes:

a furnace wall defining a combustion chamber and having an open lower end, said furnace wall being formed with a plurality of vent holes inclined relative to a radial direction of said furnace wall so as to allow air to flow into said combustion chamber therethrough and swirl within said combustion chamber;

a bottom wall connected fixedly to a lower end of said furnace wall for sealing said open lower end of said furnace wall;

a fireproofing layer disposed on inner surfaces of said furnace wall and said bottom wall; and a plurality of air tubes extending through said heat exchange space and communicated with the ambient surroundings and said vent holes, respectively.

3. The heat exchange furnace as claimed in claim 2, wherein said furnace wall and said surrounding plate are formed respectively with an opening and a fuel inlet that are aligned with each other and that are adapted to permit the fuel to be fed into said combustion chamber therethrough.

4. The heat exchange furnace as claimed in claim 1, wherein said gas-guiding unit further includes a plurality of heat-resisting upper seal rings disposed between said upper guiding module and said top annular plate so as to establish a gas-tight seal therebetween, and a plurality of heat-resisting lower seal rings disposed between said lower guiding module and said bottom annular plate so as to establish a gas-tight seal therebetween.

5. The heat exchange furnace as claimed in claim 1, further comprising a thermal insulating device including:

an annular outer layer disposed around and connected fixedly to an assembly of said passageway module and said gas-guiding unit; and an annular thermal insulating layer sandwiched between said outer layer and the assembly of said passageway module and said gas-guiding unit.

6. The heat exchange furnace as claimed in claim 1, wherein said upper guiding module includes:

a surrounding wall, a top wall connected fixedly to an upper end of said surrounding wall of said upper guiding module and cooperating with said surrounding wall of said upper guiding module so as to define an upper guiding space therebetween, said gas outlet unit being formed through said top wall, and a plurality of partitions for dividing said upper guiding space into a gas entrance chamber communicated with said combustion chamber in said combustion furnace module and one of said conduit sets, a gas exit chamber communicated with said gas outlet unit in said top wall and another of said conduit sets, and a plurality of upper gas transfer chambers each communicated with two adjacent ones of said conduit sets; and said lower guiding module includes:

two surrounding walls, one of said surrounding walls of said lower guiding module being disposed around the other of said surrounding walls of said lower guiding module, an annular bottom wall interconnected fixedly between lower ends of said surrounding walls of said lower guiding module and cooperating with said surrounding walls of said lower guiding module so as to define a lower guiding space thereamong, and a plurality of partitions for dividing said lower guiding space into at least two lower gas transfer chambers each communicated with two adjacent ones of said conduit sets.

7. The heat exchange furnace as claimed in claim 6, wherein:

said gas-guiding unit further includes a fireproofing layer disposed on surfaces of said top wall, said top annular plate, and said partitions, which define cooperatively said gas entrance chamber.

8. The heat exchange furnace as claimed in claim 7, wherein said gas-guiding unit further includes a thermal insulating layer sandwiched between said top annular plate and said fireproofing layer.

* * * * *